United States Patent [19]

Mickelson

[11] 4,128,290

[45] Dec. 5, 1978

[54] BUS BAR CONNECTION SYSTEM

[75] Inventor: Norman W. Mickelson, White Bear Lake, Minn.

[73] Assignee: Minnesota Mining and Manufacturing Company, Saint Paul, Minn.

[21] Appl. No.: 875,989

[22] Filed: Feb. 8, 1978

[51] Int. Cl.[2] ..... H01R 9/08

[52] U.S. Cl. ..... 339/97 R; 339/22 B

[58] Field of Search ..... 339/14 R, 22 B, 95 R, 339/95 D, 97 R, 97 P, 98

[56] References Cited

U.S. PATENT DOCUMENTS

| | | | |
|---|---|---|---|
| 2,997,685 | 8/1961 | Anderson | 339/22 B |
| 3,122,604 | 2/1964 | Cook et al. | 339/95 D |
| 3,918,788 | 11/1975 | Walter et al. | 339/22 B |
| 3,980,378 | 9/1976 | Keller | 339/95 R |

*Primary Examiner*—Joseph H. McGlynn

*Attorney, Agent, or Firm*—Cruzan Alexander; Donald M. Sell; Terryl K. Qualey

[57] ABSTRACT

A bus bar connector system including a bus bar which is a conductive band coated with an electrically insulating material, and a conductive contact clip which is slotted to receive the bar and locally remove the insulation therefrom to electrically connect the clip to the bar. The clip with the bar defines a receptacle for an electrical terminal post and the clip has a resilient lever arm to contact the terminal post and thus complete the electrical circuit from the post to the bus bar.

4 Claims, 3 Drawing Figures

BUS BAR CONNECTION SYSTEM

FIELD OF THE INVENTION

The present invention relates to a bus bar connection system for bussing electrical terminal posts.

BACKGROUND OF THE INVENTION

Electrically conductive bus bars are frequently used to provide a common electrical connection between several terminal posts in an extended array of terminal posts, for example in the back plane of a telephone panel board in a main office. Conductive clips are either integrally formed with the bar or are provided as a separate part, each clip being formed to receive a terminal post to make electrical connection from the terminal post through the bus bar to the other terminal posts to be connected. Such bus bar systems are disclosed in U.S. Pat. Nos. 3,551,875; 3,582,864; 3,868,163; 3,918,778; 3,951,497; 3,985,414; and 4,029,377. In each of these systems the bus bar is conductive along its entire length and if it is desired to connect less than all of the terminal posts in a row together, portions of the bus bar must be separately insulated from the posts which are not to be connected as disclosed in U.S. Pat. Nos. 3,582,864 and 3,951,497. Thus, it is necessary with these prior art systems for the user to apply the insulation to appropriate portions of the bus bar, or the bus bar must be specially ordered for the customer's use. Often, both one of these alternatives are unacceptable.

SUMMARY OF THE INVENTION

The present invention provides a system for electrical connection between an electrical terminal post and a common conductor comprising a bus bar which is a conductive band coated with an electrically insulating material and a conductive contact clip for connection to the conductive band to permit conductive connection between the bus bar and a terminal post. The clip comprises a generally U-shaped body with parallel side walls joined by a base wall, the side walls being similarly formed with an arm extending away from the base wall and then parallel to the base wall to define a slot parallel to the base wall. Each of the side walls is formed with a pair of insulation piercing projections adjacent the entrance to the slot therein and spaced to scrape the insulation from the bus bar as it is moved into the slot, and the base wall is formed with a resilient lever arm extending into the space between the side walls for contacting a terminal post inserted between the side walls. Thus, the bus bar may be inserted into the slots in the side walls of the contact clip anywhere along the bus bar.

When inserted into the slots the bus bar is in a position generally parallel to the base wall of the clip and the insulation piercing projections have scraped insulation from the bus bar to electrically connect the clip to the bus bar. The space encompassed by the bus bar and the U-shaped body of the clip form a receptacle for a terminal post and the resilient lever extending into the receptacle provides contact to the terminal post therein and thereby makes electrical connection from the terminal post to the bus bar through the clip. Several clips may be placed on the bus bar at locations corresponding to the spacing of the electrical terminal posts desired to be connected, while the remainder of the posts in the row will be insulated from the bus bar by the coating on the bus bar.

THE DRAWING

Figure 1:
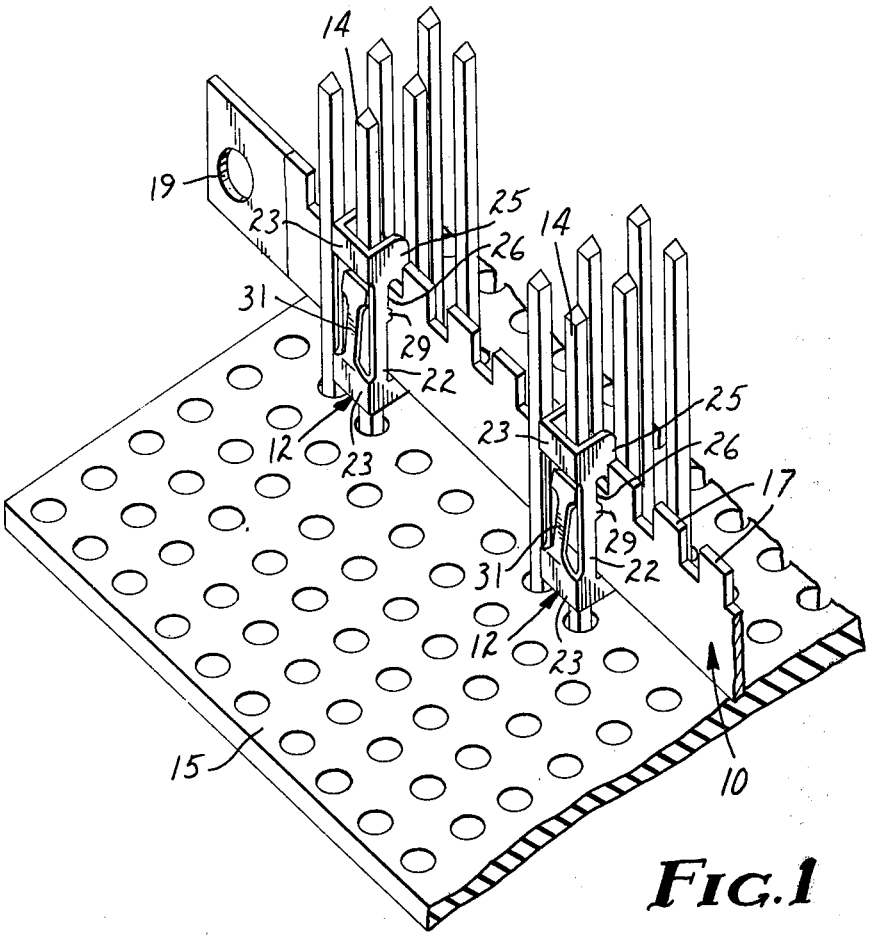
FIG. 1 is a perspective view of a portion of a circuit board having an array of electrical terminal posts in which selected posts are connected by the electrical connection system of the present invention.
Figure 2:
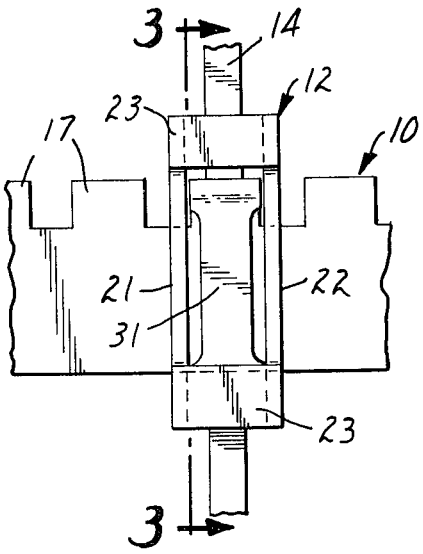
FIG. 2 is an elevation view of a portion of the bus bar and a contact clip of the electrical connection system of the present invention.

The electrical connection system of the present invention is provided to connect an electrical terminal post to a common conductor and it includes a bus bar 10 and at least one contact clip 12. In FIG. 1 two contact clips 12 are illustrated electrically connecting two terminal posts 14 in an array of terminal posts on a circuit board 15 through the bus bar 10.

The bus bar 10 is a conductive band of copper coated with an electrically insulating material, preferrably an epoxy resin. Along one edge, the bus bar is formed with lugs 17 that are spaced on centers corresponding to the center spacing of adjacent terminal posts in a standard terminal post array, the most common standards being 2.54 millimeter (0.100 inch) and 3.17 millimeter (0.125 inch) center spacings. The lugs 17 define locations for contact clips 12 to properly locate the clips for use on a standard array of terminal posts as will be more fully described hereinafter. The insulation is removed from one end of the bus bar and an aperture 19 is made therethrough to permit attachment to the bus bar by a quick slide connector or by soldering a wire to the end of the bus bar 10 through the aperture 19.

The contact clip 12 is electrically conductive and it has a generally U-shaped body with parallel side walls 21 and 22 joined by a base wall 23. The side walls are similarly formed, each having an arm 25 extending away from the base wall 23 and then parallel to the base wall to define a slot 26 parallel to the base wall 23. Each of the side walls is formed with a pair of insulation piercing projections 28 and 29 adjacent the entrance to the slot 26 therein and spaced to scrape the insulation from the bus bar 10 as it is moved into the slots 26.

In the illustrated embodiment, the projections 28 extending from the side wall arms 25 are formed much like saw teeth having a relief angle of about 10°. It has been found desirable to form at least one of the projections in each pair of projections 28 and 29 in this manner with a relief angle of from 8° and to 11° to most effecctively remove the insulation from the bus bar 10 to make effective electrical connection thereto.

The base wall 23 of the contact clip 12 is formed with a resilient lever arm or leaf spring 31 extending into the space between the side walls. Each of the side walls 21 and 22 is formed with a shoulder extending generally perpendicularly away from the base wall 23 to a position spaced from and opposed to the entrance to the slot 26 in the side wall. The side wall shoulder 33 of each side wall is spaced from the closed end of the slot 26 therein a distance generally equal to the width of the bus bar 10 at the points between the lugs 17.

Figure 3:
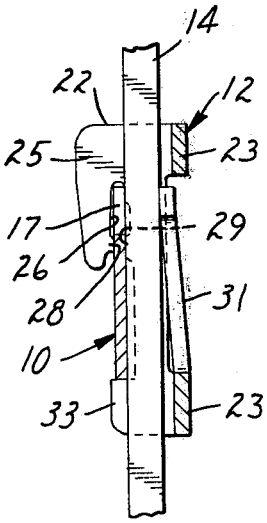
FIG. 3 is a cross sectional view taken generally along line 3—3 of FIG. 2.

In use, a contact clip is positioned with the arms 25 of its side walls 21 and 22 at opposite sides of a lug 17 on the bus bar. The lugs 17 have a width longitudinally of the bus bar generally equal to the spacing between the side walls 21 and 22 of the contact clip 12 to locate the clip positions on the bar. The bus bar 10 is then inserted into the slots 26 in the side walls 21 and 22 of the contact clip 12. The contact clip 12 and bus bar 10 must be brought together at a slight angle until the bus bar clears the side wall shoulders 33 when it can be moved into position generally parallel to the base wall 23 of the contact clip 12. As the clip 12 is moved onto the bus bar 10 the insulation piercing projections 28 and 29 scrape the insulation from the bus bar to electrically connect the clip 12 to the bus bar 10. With the contact clip 12 in position on the bus bar 10 as illustrated in the drawing, the space encompassed by the bus bar and the U-shaped body of the clip form a receptacle for a terminal post with the resilient lever arm 31 of the contact clip extending into the receptacle to contact a terminal post therein and thereby make an electrical connection from the terminal post to the bus bar through the clip as can most clearly be seen in FIG. 3.

In one specific embodiment the bus bar was formed of copper alloy CDA 110 ("CDA____" is a standard copper alloy designation of the Copper Development Association, a United States of America trade association) having a thickness of 0.30 mm, a width between lugs 17 of 3.68 mm and a width to the top of the lug of 4.75 mm. The lugs 17 were formed with a width of 1.52 mm and a center spacing of 2.54 mm. The insulating material on the bus bar 10 was 3M Scotchcoat Brand Protective Resin No. 203 available from the Electro Products Division of Minnesota Mining and Manufacturing Company with offices at Saint Paul, Minnesota.

The contact clip 12 was formed of ¼ hard copper alloy CDA 172 having a thickness of 0.30 mm. The spacing between the side walls 21 and 22 was 1.69 mm. The slots 26 had a width of 0.33 mm with the spacing between the projections 28 and 29 reduced to 0.20 mm. The distance from the side wall extensions 33 to the closed end of the slots 26 was 4.06 mm. The overall height of the clip 12 was 6.35 mm.

It will be readily appreciated that with the system of the present invention, the bus bar 10 may be produced in long lengths which are rolled up for shipment and storage. The user himself may then cut the length of bus bar 10 that he wishes to use and put contact clips 12 on at appropriate positions along the bus bar corresponding to the terminal posts he desires to connect.

I claim:

1. A system for electrical connection between an electrical terminal post and a common conductor comprising:

a bus bar comprising a conductive band coated with an electrically insulating material, and a conductive contact clip for connection to said conductive band to permit conductive connection between said bus bar and a terminal post, said clip comprising a generally U-shaped body with parallel side walls joined by a base wall; said side walls being similarly formed, each side wall having an arm extending away from said base wall and then parallel to said base wall to define a slot parallel to said base wall, a pair of insulation piercing projections adjacent the entrance to said slot and spaced to scrape the insulation from said bus bar as it is moved into said slot, and a shoulder extending away from said base wall to a position spaced from and opposed to the entrance to said slot, said extension being spaced from the closed end of said slot a distance generally equal to the width of said bus bar; and said base wall being formed with a resilient lever arm extending into the space between said side walls for contacting a terminal post inserted between said side walls, whereby said bus bar may be inserted into said slots in said side walls of said contact clip to a position generally parallel to said base wall of said clip, said insulation piercing projections scraping insulation from said bus bar to electrically connect said clip to said bus bar and the space encompassed by said bus bar and said U-shaped body of said clip forming a receptable for a terminal post, said resilient lever arm extending into said receptacle to contact a terminal post therein and thereby make electrical connection from the terminal post to said bus bar through said clip.

2. The electrical connection system of claim 1 wherein said bus bar has a plurality of equally spaced lugs extending from one edge, said lugs having a width longitudinally of said bus bar generally equal to the spacing between said side walls of said contact clip, said lugs being spaced on centers equal to a standard spacing for an array of said terminal posts, whereby a plurality of said contact clips may be positioned on said bus bar with a said lug between the side walls of each contact clip to properly locate said clips for use on a standard array of terminal posts.

3. The electrical connection system of claim 1 wherein said insulating material is an epoxy resin.

4. The electrical connection system of claim 1 wherein at least one of said insulation piercing projections in each pair of projections is formed as a saw tooth with a relief angle of from 8° to 11°.

* * * * *